US005886603A

United States Patent [19]

Powell

[11] Patent Number: 5,886,603

[45] Date of Patent: Mar. 23, 1999

[54] ELECTRICALLY CONTROLLED TRIPPING MECHANISM

[75] Inventor: Simon Powell, Baldock, United Kingdom

[73] Assignee: Power Breaker PLC, Templefields, United Kingdom

[21] Appl. No.: 765,202

[22] PCT Filed: Jun. 30, 1995

[86] PCT No.: PCT/GB95/01556

§ 371 Date: Apr. 10, 1997

§ 102(e) Date: Apr. 10, 1997

[87] PCT Pub. No.: WO96/01488

PCT Pub. Date: Jan. 18, 1996

[30] Foreign Application Priority Data

| | | | |
|---|---|---|---|
| Jul. 4, 1994 | [GB] | United Kingdom | 9413409 |
| Jul. 4, 1994 | [GB] | United Kingdom | 9413410 |
| Jul. 4, 1994 | [GB] | United Kingdom | 9413411 |
| Jul. 12, 1994 | [GB] | United Kingdom | 9413982 |
| Nov. 10, 1994 | [GB] | United Kingdom | 9422713 |
| Nov. 11, 1994 | [GB] | United Kingdom | 9422818 |

[51] Int. Cl.[6] ..... H01H 9/20

[52] U.S. Cl. ..... 335/164; 335/21; 335/26; 335/27; 335/38; 335/166; 335/167; 335/170; 335/171; 335/172; 335/174; 200/318; 200/323; 200/325

[58] Field of Search ..... 335/21, 26, 27, 335/38, 164–176; 200/318, 318.1, 323, 325

[56] References Cited

U.S. PATENT DOCUMENTS 4,409,574 10/1983 Misencik ..... 335/18

5,408,058 4/1995 Homik et al. ..... 200/50 R

FOREIGN PATENT DOCUMENTS 2609838 7/1988 France .

*Primary Examiner*—Michael L. Gellner
*Assistant Examiner*—Raymond Barrera
*Attorney, Agent, or Firm*—Watson Cole Grindle Watson PLLC

[57] ABSTRACT

A detent mechanism comprising a support member having a fixed seating member comprising opposite sides; a first spring for exerting a first spring force, disposed between one side of the fixed seating member and a first sliding member, further comprising a second spring member exerting a second spring force less than said first spring force, disposed between the other side of said fixed seating member and a second sliding member, whereby the forces of the springs are directed to operate on said first and second sliding members in opposite directions. A push button can apply an external force to the first sliding member to move it from a first position relative to the fixed seating member to a second position against the action of said first spring force. A detent mechanism connects the first and second sliding members when the first sliding member is in its second position and the second slidable member is in a first position. When the members are subsequently not acted on by said push button, the first sliding member returns towards its first position and the second sliding member is constrained by the detent mechanism to move with the first sliding member to a second position, the resultant force on both said slidable members in the direction of the first spring force being the difference between the first spring force and the second spring force.

15 Claims, 7 Drawing Sheets

ELECTRICALLY CONTROLLED TRIPPING MECHANISM

The present inmention relates to trip switches and more particularly to a trip switch which can be used for domestic and light industrial use.

The present invention will be described in relation to the construction and operation of a trip switch incorporated in a residual current device (RCD). This description is for convenience only and it will be appreciated that the construction and operation of the mechanism are suitable for other uses.

We propose to use a detent mechanism as part of the tripping mechanism.

The use of detent mechanisms is common for retaining mechanical parts in a particular relationship to each other. In general teems such a mechanism will comprise a resiliently mounted pawl which under the influence of its resilient mounting will engage a recess on a movable member. That movable member will be retained in position by the detent pawl until such time as a force acting on the movable member to move that member past the pawl rises to a value sufficient to move the detent aside to allow the movable member to pass. Such assemblies are commonly found in car gear boxes and as latches for cupboard doors.

Generally such detent mechanisms provide a fixed holding force or at best a force which can be periodically adjusted by means of increasing the pre-load on a spring which is typically provided in the resilient mounting. As a result in use, such devices provide a constant resilient force which is either overcome or not according to the force applied to the movable member. This means that such mechanisms cannot be used as a control means to retain or release components depending on known external parameters.

A detent mechanism which can respond to extend parameters in disclosed in U.S. Pat. No. 4,409,574. The single button circuit interrupter disclosed therein uses a detent mechanism controlled by a solenoid to selectively latch or release the power contacts depending on whether the circuit being controlled is operating correctly. This device has the disadvantage that the solenoid operating correctly. This device has the disadvantage that the solenoid is connected to the stationary outer shell, while the armature operated on is connected to the moving contact member. This makes it difficult to arrange for the solenoid to control the armature, the armature moving relative to the solenoid during operation.

FR-A-2609838 discloses a tripping mechanism using a detent mechanism. The actuation of the pawl in the detent mechanism described in this publication is carried out mechanically by slots of various shapes all acting on protuberances on the pawl member. The movement of the slots is caused by the action of springs on rotation of a knob. This is a very complicated mechanism for actuating a pawl and would cause great unreliability in the mechanism.

According to the present invention there is provided a detent mechanism comprising a support member having a fixed seating member comprising opposite sides;

a first spring for exerting a first spring force, disposed between one side of the fixed seating member and a slidable seating member, further comprising a second spring member exerting a second spring force less than said first spring force, disposed between the other side of said fixed seating member and a second slidable seating, member, whereby the forces of the springs are directed to operate on said first and second slidable members in opposite directions, means for applying an external force to the first slidable seating member to move the first slidable seating member from a first position relative to the fixed seating member to a second position against the action of said first spring force, and means for releasably connecting the first slidable seating member to said second slidable seating member when said first sliding member is in its second position and said second slidable member is in a first position, such that when said members are not acted on by said external force, said first slidable member returns towards its first position and said second slidable member is constrained to move with said first slidable member to a second position, the resultant force on both said slidable members in the direction of said first spring force being the difference between said first spring force and said second spring force wherein characterised in that the releasably connecting means comprises an electro-mechanical arrangement carried by one of said suitable seating members, which arrangement includes a pawl and an electrically energised device for controlling the movement of said pawl.

This invention therefore provides a retain/release mechanism which is simple in design and uses relatively few components and the device can be made quite small. This has particular-applicability to small devices such as miniature circuit breakers (MCBs), portable residual current devices (RCDs) and robotic arms.

A specific embodiment of the invention will now be described by way of example with reference to the accompanying drawings in which FIG. 1 shows a diagrammatic sectional side view of a tripping and switch mechanism according to the present invention.

Dealing firstly with the basic setting/resetting operation, the operation is that a push button will be depressed in order to reset the contacts and then released. If the push button is again depressed, testing of a trip circuit will be undertaken but thereafter the push button will have to be released before it can be depressed again in order to reset the contacts.

Figure 1:
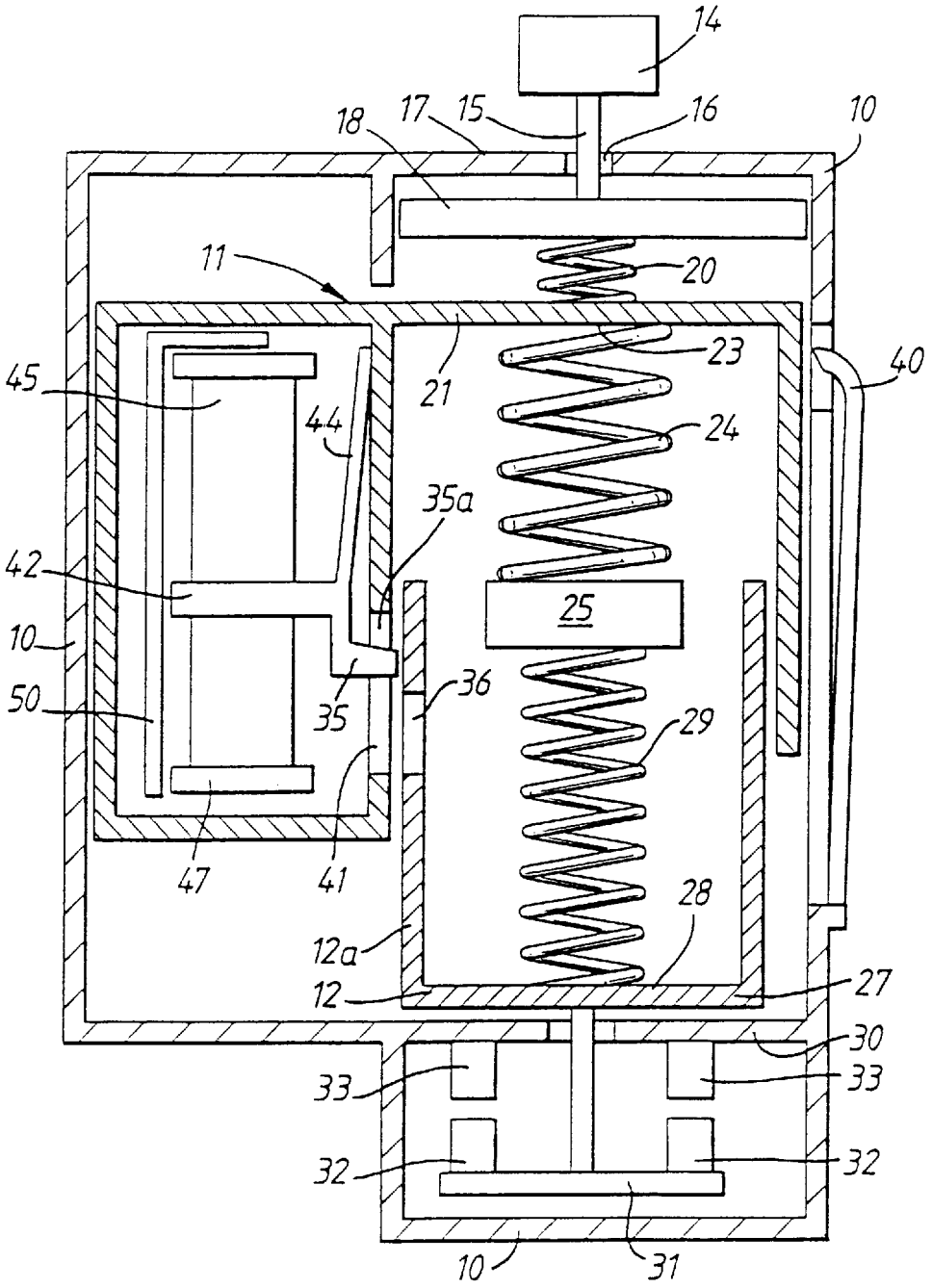

As shown in FIG. 1, the mechanism comprises a relatively fixed structure 10 which houses, wholly or in part, movable members 11 and 12 which slide relative to each other and to the structure 10. A manually operable member 14 in the form of a push button has a plunger 15 which extends through an opening 16 in one wall 17 of the structure 10. A spring engaging flange 18 is provided on one end of the plunger 15 and a light spring 20 is disposed between the flange 18 and the exterior of the top 21 of the movable member 11 which is a generally inverted U-shaped member when seen in FIG.

1. The interior surface of the top 21 of the member 11 forms a spring seat 23 for strong spring 24 which is disposed between the spring seat 23 and a fixed ledge 25 which forms part of the structure 10. The springs 20 and 24 are normally i.e. in their most relaxed state,under slight compression.

Slidably disposed within the inverted U-shape member 11 is the member 12 which has a U-shape when seen in FIG. 1. The bight portion 27 of the member 12 forms a spring seat 28 for a further spring 29 which is disposed between the spring seat 28 and the other side of the ledge 25 from the side of the ledge which engages the heavy spring 24. The spring 29 is not as strong as the spring 24. Movement of the member 12 under the action of the spring 29 is limited in some convenient manner for example by a stop member 30 which is part of the structure 10. The member 12 is provided with contact carrier 31 having one or more contacts 32 provided thereon. The contacts 32 face fixed contacts 33 and these contacts 32–33 constitute the main current carrying contacts for the device.

The member 11 is provided with an electrically actuable arrangement which moves with the member 11 and includes a detent 35 which, when it is desired to cause the contacts to close, is held in engagement in a slot 36 in the arm 12*a* of the member 12. The electrically actuable arrangement for holding the detent 35 will be described in detail later.

The operation of the above described arrangement is as follows assuming that the contacts 32,33 and are normally open and the detent 35 is in its retracted or relaxed condition. The springs 20, 24 and 29 are all in their most relaxed state and the members 11 and 12 are in their extended positions relative to the fixed ledge 25. The push button 14 is pressed which firstly compresses the light spring 20 and then subsequently causes the member 11 to move downwards thus compressing the strong spring 24 by manual operation. The member 12 is in its downmost position and is still stationary being held against a stop 30 by spring 29. If the electrically actuable arrangement which controls detent 35 is in the appropriate condition, the detent 35 will be held in an outward condition in the slot 36 in the member 12 when the member 11 slides downwards into the appropriate position. This links the two slidable members 11,12 together.

When the push button 14 is released, the two linked members 11,12 move upwards together under the action of the strong spring 24 which compresses the spring 29 and brings the contacts 32 into engagement with the fixed contacts 33. Since the push button is then released, this results in the push button 14 returning to its initial position under the action of the spring 20. However, the member 11 does not return to its initial condition; it is held in a slightly depressed position with the strong spring 24 slightly compressed.

If a fault condition exists, the detent 35 is forced out of the slot 36 due to the action of the springs 24 and 29 and the relative slopes of the mating surfaces of the detent 35 and the slot 36. In any event, the spring 29 acting between the fixed ledge 25 and the bight of the member 12 opens the contacts 32,33. This also allows both the member 11 and the member 12 to return to their original position.

It will be appreciated that if the correct conditions do not exist, when the member 11 is pushed down by the push button, the detent 35 will not catch in a slot 36 of the member 12 when the push button is released and hence the member 12 will not be lifted up by the spring 24 to close the contacts 32,33.

The single push button operation described here can be achieved using modified versions of the above mechanism.

For example, the compression springs 24, 29 and 20 could be replaced by tension springs arranged to exert a force in the same direction as that described above. The springs 24 and 29 could be mounted on separate parts of the housing at the top and bottom of the housing respectively, strong spring 24 pulling member 11 upwards and weaker spring 29 pulling member 12 downwards, the operation taking place in the same direction as that shown in FIG. 1.

Furthermore, there is no reason why the weak spring 20 should be a compression spring or that it should act on member 11. The important feature of the push button action is that there should be a general upward force on it relative to the housing 10 and that, over the lower part of its movement range, it should act directly on the member 11, so that member 11 is forced to move at least as far as the button arrangement 14, 18 over this lower part of the range. The spring could therefore be mounted between the button arrangement and the mounting 10, pushing upward on the button and downward on the mounting. This could be by means of a compression spring or tension spring depending on the desired arrangement.

It should further be stressed that, although the springs 20, 24 and 29 are throughout this description referred to in the singular, there is no reason why a plurality of springs could not replace one or all of them. The use of single springs in the specific embodiment shown in the figure is purely for simplicity.

The operation described thus far is simply a push to set or reset operation. It is intended that the same push button will be used to perform a test function to ensure that the electrically actuable arrangements and any associated fault detector is also operating properly. This is achieved by using the push button to operate a test circuit in some convenient manner. In order to ensure correct operation, a pawl 40 is also provided on the fixed structure 10 as will be explained in detail.

The pawl 40 is biased inwardly towards the slidable member 11 by virtue of its mounting on a leaf spring. The position of the pawl 40 is such that when the slide member 11 is in the position where the contacts 32,33 are engaged and the slide members 11,12 are also linked to each other by the detent 35, the pall 40 can interpose itself between the top of the member 11 and the bottom face of the flange 18 when the push button is released and rises under the action of spring 20. In this position, downward movement of the flange 18 caused by pressing the push button 14 is restricted by the pall and hence manual force cannot be applied to the slide member 11 which might otherwise cause opening of the contacts 32,33. Thus, the push button 14 can be reciprocated through a restricted-length and thus undertake a test cycle.

Figure 2A:
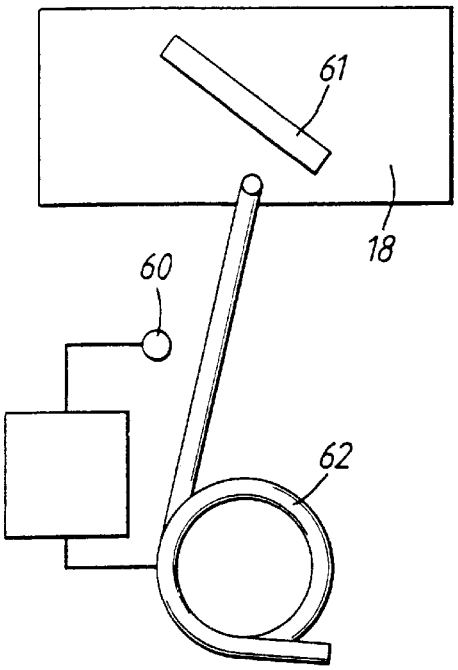
FIG. 2 shows a first embodiment of a mechanism for operating a test function.
Figure 2B:
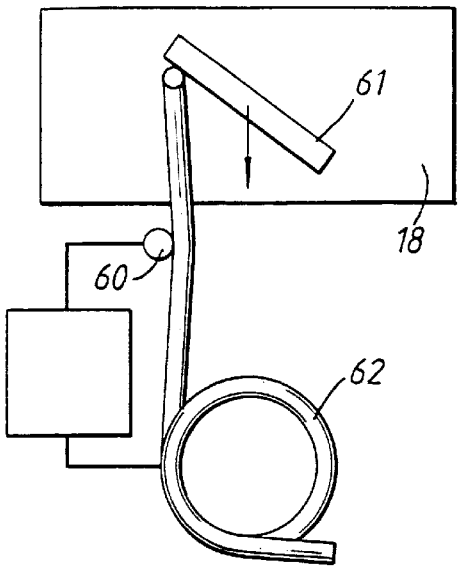
Figure 2C:
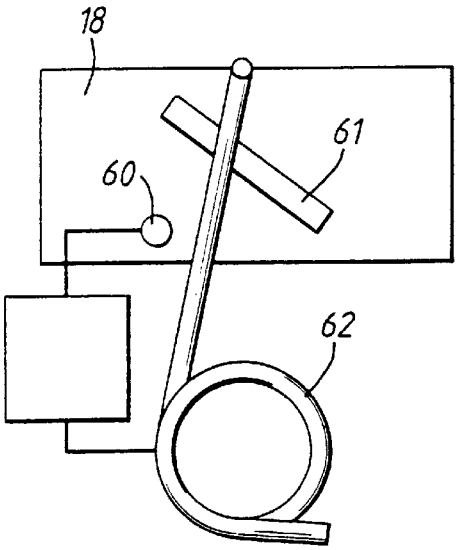
Figure 2D:
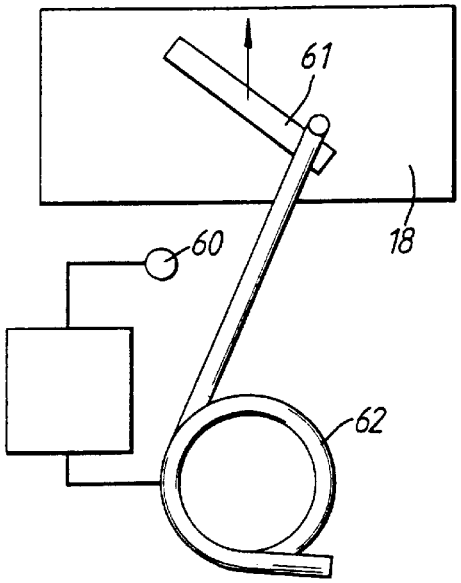

FIGS. 2*a,b,c,d* show one way in which this reciprocation can be used to initiate a test function on depression of the push button and subsequent termination of the test function on release.

As is shown in each of FIGS. 2*a,b,c,d,* the flange 18 is provided with a sloping projection 61. This projection is arranged to engage a sprung member 62. The sprung member is arranged with its axis substantially in the same direction as the permitted movement of flange 18, and has its lower end fixed, while its upper end is arranged to be bendable about its lower end in the plane containing the direction of permitted motion of the flange and the direction of slope of the projection 61. In the rest state of the flange, the protruberence is situated above the upper end of said sprung member as shown in FIG. 2*a*. As the push button is depressed, flange 18 and projection 61 move downwards, said projection engaging the sprung member. As the projection is angled, a horizontal component of force is exerted on the spring member, the upper end of which therefore moves substantially horizontally in the direction of upward slope of the projection. A contact 60 is arranged to engage the spring member close to the limit of its motion, while still allowing movement of the upper end of the spring member. This allows electrical contact between the spring member and the contact 60, thereby completing a fault simulation circuit 1. On further downward motion of the flange, the upper tip of the projection 61 passes the upper end of the spring member 62 releasing it back to its unstrained position and breaking the simulation circuit 1. The flange 18 will thus continue down until restrained by the pall 40. On release of the push button, the projection 61 engages the spring member from below. The angular disposition of the projection 61 thus causes a horizontal component of force to be exerted in the opposite direction to that of the downstroke, such that the spring member 62 does not mechanically interfere with any other components. Before the push button is fully released, the projection moves beyond the upper end of the spring member 62, which therefore disengages and returns to its unstressed state. In other words, movement of the push button and flange in straight line reciprocation causes contact 62 to be pushed towards a fixed contact member 60, released to return to its initial condition, pushed away from said fixed contact member 60, and finally released to return to its initial condition.

Figure 3A:
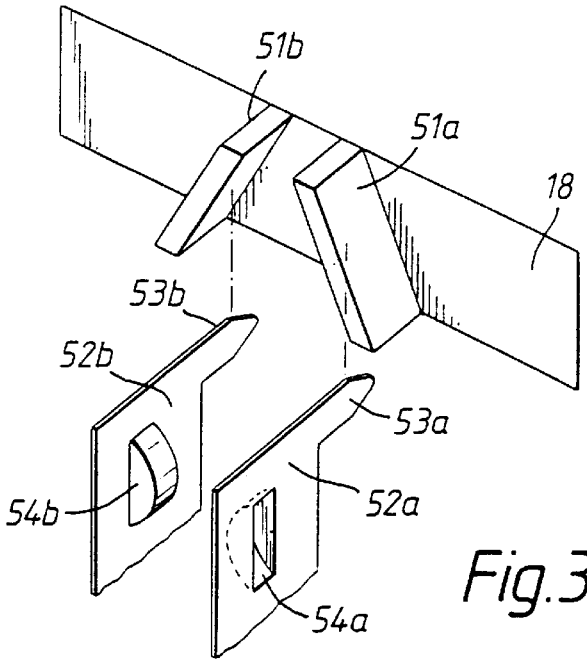
FIG. 3 shows a second embodiment of a mechanism for operating a test function.
Figure 3B:
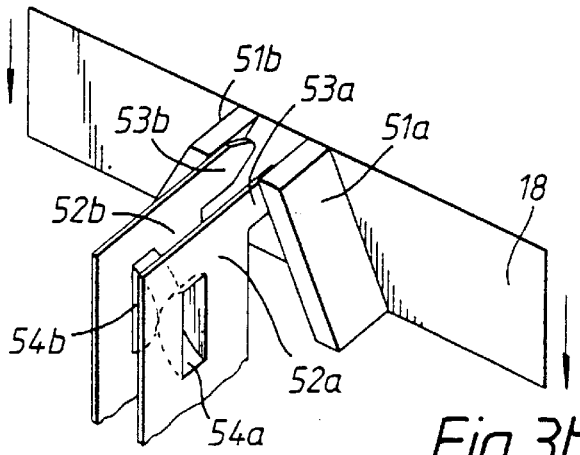
Figure 3C:
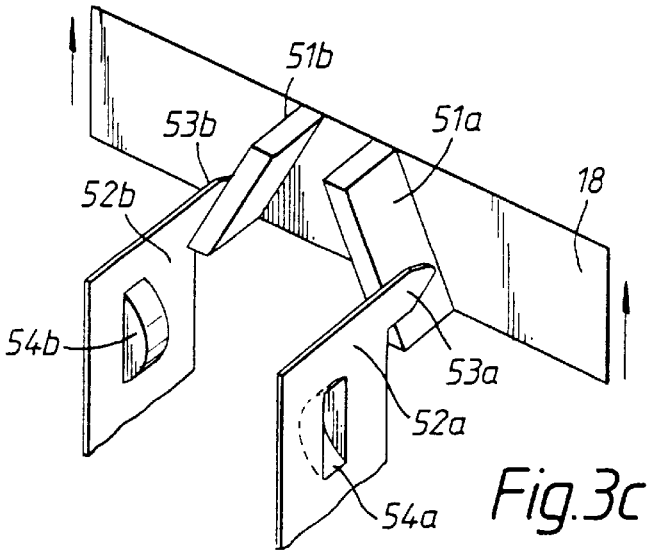

FIG. 3 shows another way in which this reciprocation can be used to initiate a test function on depression of the push button and subsequent termination of the test function on release.

As best shown in FIG. 3*a*, the flange 18 is provided with two sloping projections 51*a,b* which are disposed as shown to form an inverted V-shape with the apex of the V missing. The thus spaced apart projection are arranged to receive between them the tips 53*a,b* of two contact members 52*a,b* of the test circuit. The contact members 52*a,b* may be of conductive resilient material and may be formed with resilient contact portions 54*a,b*. The contact portions are usually opened with the members 52 spaced apart by a small distance. As the push button is depressed, the flange 18 moves downwards as indicated by the arrow in FIG. 3*b*. The tips 53 of the contact members 52 are engaged by the inner sloping surfaces of the projections 51 and are pressed towards each other due to the cam action of the projections 51. The dimensions are such that the contact portions 54 will engage each other to complete the test circuit but the flange 18 will be able to move in a direction of the arrow until the projections 51 disengage from the tips 53 whereupon the members 52 spring apart breaking the test circuit. The flange 18 will thus continue down until restrained by the pall 40.

On release of the push button, the flange 18 moves upward and in doing so, the outer sloping surfaces come into engagement with the tips 53 of the contact members 52 which are in their normal open condition. The contact members 52 are then forced apart by the cam action of the projections 51 as the flange 18 continues to move upward until the tips 53 disengage from the surfaces whereupon they return to their normal open position and the push button turns to it's initial position. In other words, movement of the push button and flange in straight line reciprocation causes the contact members 52 to be pushed towards each other, released to return to their initial condition, pushed away from each other and finally released to return to their initial condition.

From the above description, it will be appreciated that the test cycle can be completed without mechanically interfering with the operation of the remainder of the setting mechanism. It will also be appreciated that with the main contacts 32, 33 in their open condition and all the springs relaxed, on initially pressing the push button, the first thing which is tested is the test circuit and then on continued downward movement the contacts 32,33 are engaged if no fault condition is detected and the push button is released. The test procedure is then carried out by a further depression of the push button 14 which should cause the contacts 32 and 33 to open and by opening, the slidable member 11 rises upwards from its latched position as described previously to its initial position which causes the pawl 40 to be forced outwards as shown in the drawing. When the push button is depressed again, the contacts can be reset in the knowledge that the test function is operating properly.

Figure 4A:
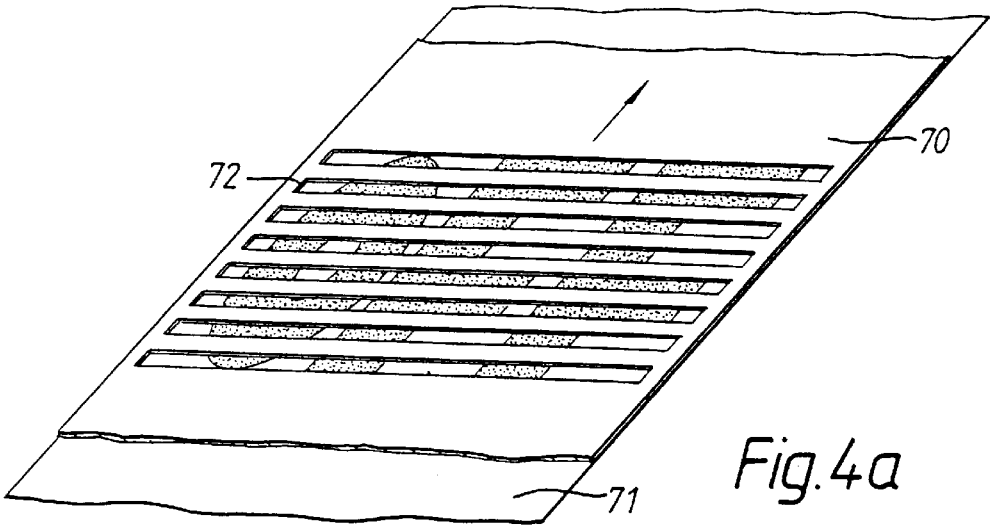
FIG. 4 shows an embodiment of a flag mechanism for the device of the invention.
Figure 4B:
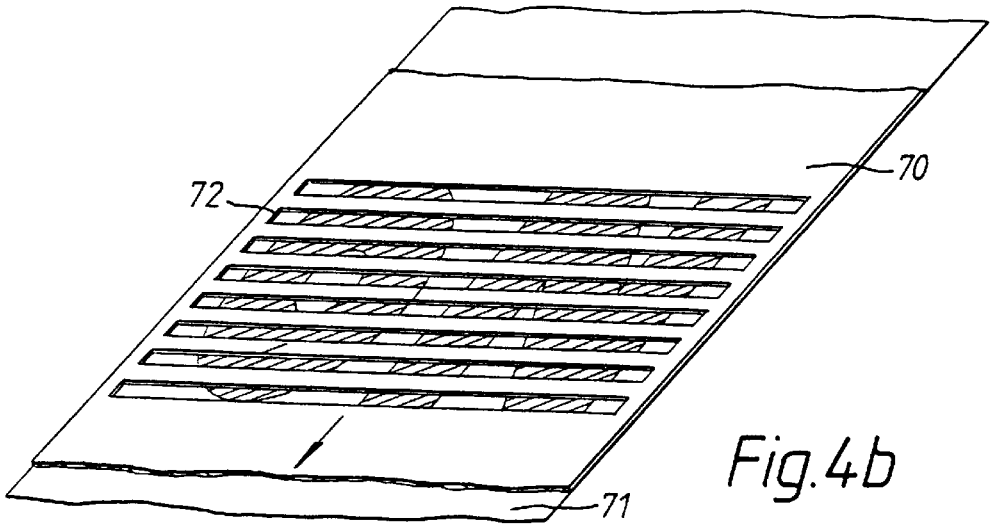
Figure 4C:
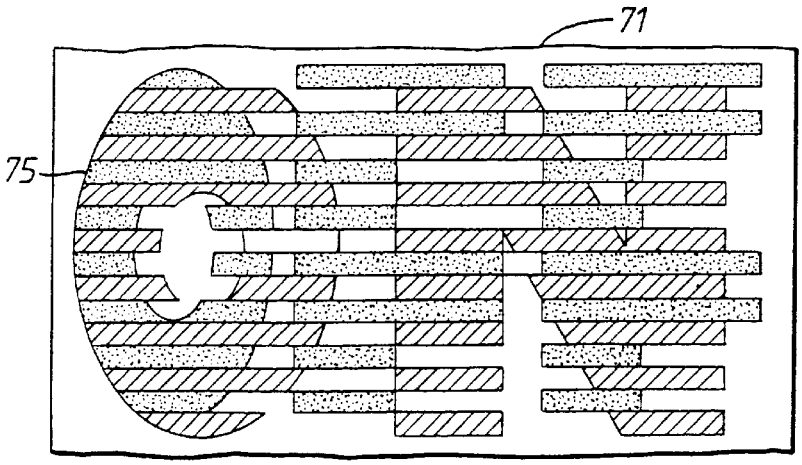

Turning now to the visual indication of the condition of the contacts 32,33, as shown in FIG. 4, it is proposed that a sheet member 70 is arranged to slide with the member 12 relative to a further sheet member 71 which is preferably fixed to the exterior of the structure 10 but may be movable with the member 11. FIGS. 4*a,b* show a perspective view of members 70 and 71 in the two relative positions that they are arranged to adopt. FIG. 4*c* shows a pattern that could be used on member 71. The relevant features of this pattern will become obvious from the following description of the operation of the indication means.

The sheet 70 is provided with a plurality of slits 72 through which predetermined areas 75 of the sheet 71 can be seen so that in one relative position of the sheets a first visual indication is made while in a second relative position of the sheets a second visual condition is made. For example, in one position the overall impression of both sheets could be black with a red condition being shown when the sheets are in their second relative position. Alternatively or additionally, when the contacts 32,33 are engaged, the sheets can actually display the word "on" in red. When disengaged, the sheets might display the word "off" or simply remain blank.

In another embodiment of this arrangement, said second sheet 70 is translucent and has an etched surface giving it refractive properties such that in one relative position of the sheets, a first visual condition is made, and in a second relative position of the sheets, a second visual condition is made, as in the above embodiment.

Although mention has been made in the above description of upward and downward movement, it will be appreciated this merely is in respect of the drawing and not indicative of the actual operative orientation of the mechanism.

Attention is now directed to the mechanism which controls the detent 35. A preferred embodiment of this mechanism is illustrated in FIG. 1. As can be seen from FIG. 1, the detect 35 is formed on one end of an arm 44 which is mounted on the slidable member 11 in such a way as to form a leaf spring biased towards the interior space formed by the inverted U-shape of the member 11. The preferred arrangement is that the detent 35 will in the normal unstressed condition of the arm 44 project through an opening 41 in one arm of the U-shaped member 11. The arm 44 is also provided with a pair of horns 42 which project in a direction opposite to the direction of the detent 35 and embrace the core of a coil 45. The coil 45 extends in a direction parallel to the line of action of the springs in the main mechanism. One end of the coil 45 is provided with a pole piece 47 made from a magnetic material. A basically L-shaped keep member also of a magnetic material is provided on the exterior of the coil 45 with the short leg of the L-shaped member overlapping the other end of the coil 45 and the long leg of the L-shaped member extending down the length of the coil 45 until free its end is adjacent the pole piece 47. The long leg of the keep member 50 and/or the horns 42 are shaped so that the horns are in contact with the keep member 50. The horns are of a non-magnetic material. It is also to be noted that the short leg of the L-shaped keep member is movable on the end of the coil 45 but may be retained in this location by a spring (not shown).

When no current is applied to the coil, the L-shaped keep member has its free end slightly spaced from the pole piece 47 and the detent 35 projects through the slot 41. The arrangement is such that the detent is free to move to the left as shown in the drawing when the coil 45 is unenergised. The detent is provided with a surface 35*a* which is sloping with respect to its direction of movement and consequently with the coil 45 unenergised the spring force exerted by the spring 29 on the movable member 12 is sufficient to cause the detent 35 to be moved out of the way to permit free movement of the slidable member 12 up and down. However, when the coil 45 is energised, the L-shaped keep member is attracted to the pole piece 47 and held there. This results in a force being applied to the detent 35, in addition to the natural spring force applied by the arm 40, due to the horns 42 contacting and hence tending to move with the L-shaped member 50.

A degree of resilience is provided due to the fact that the end of the L-shaped member which projects round the other end of the coil 45 opposite to the pole piece 47 is not mechanically rigidly fixed to the coil nor is it subject to the same magnetic forces as the other end and hence is free to move to a small extent. This permits the detent 35 to be pressed backwards towards the coil 45 even when the coil is energised so as to permit relative movement between the members 11 and 12 during the resetting operation.

Finally, it will be noted that the detent operating mechanism is housed in a chamber attached to the movable member 11 but that the whole of the movable member 11 with coil slides as one within the structure 10.

Figure 5:
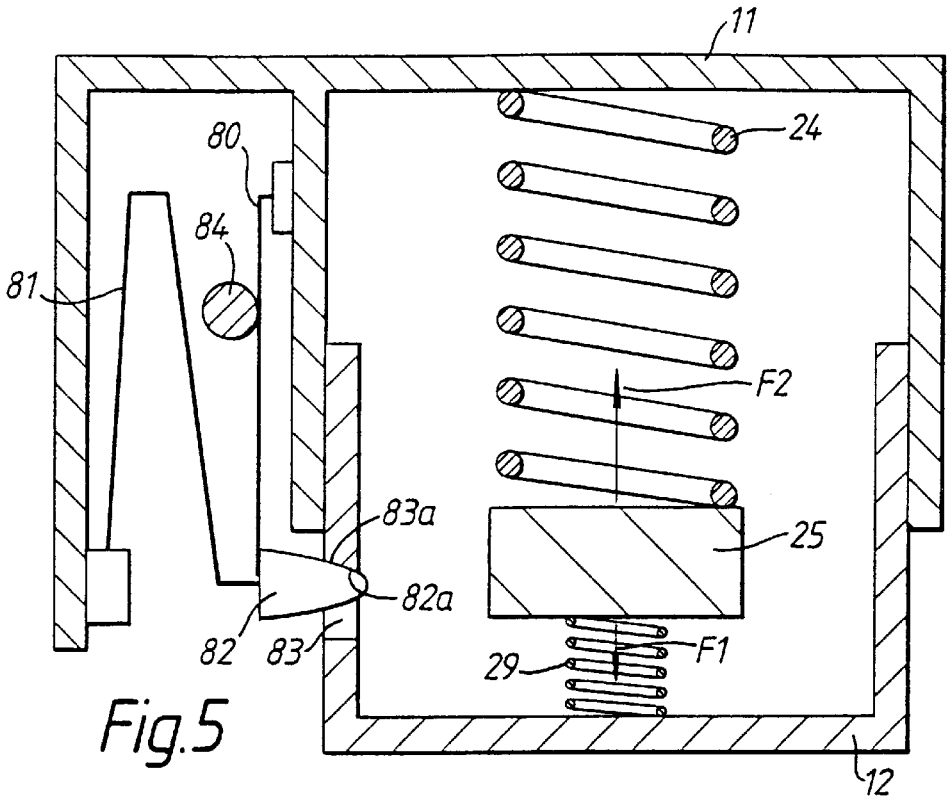
FIG. 5 shows a further embodiment of the detent mechanism according to the present invention.

In another embodiment of this detente mechanism, illustrated in FIG. 5, movable members 11 and 12 are constrained to move vertically in the sense of FIG. 5. Member 12 is biased downwards in the sense of FIG. 5 by a force F1 applied by helical spring 29. Member 11 is biased upwards in the sense of FIG. 5 by a force F2 applied by helical spring 24.

Also attached to member 11 is leaf spring 80 having at its lower end a detent pawl 82. Leaf spring 80 is configured to bias detent pawl 82 to the right in the sense of FIG. 5. There is also provided a piezo ceramic hairpin assembly illustrated schematically at 81. This assembly 81 is mounted at its left end on another part of member 11 and has its right hand end attached also to pawl 82. Thus both spring 80 and assembly 81 apply horizontal forces to pawl 82.

Figure 6:
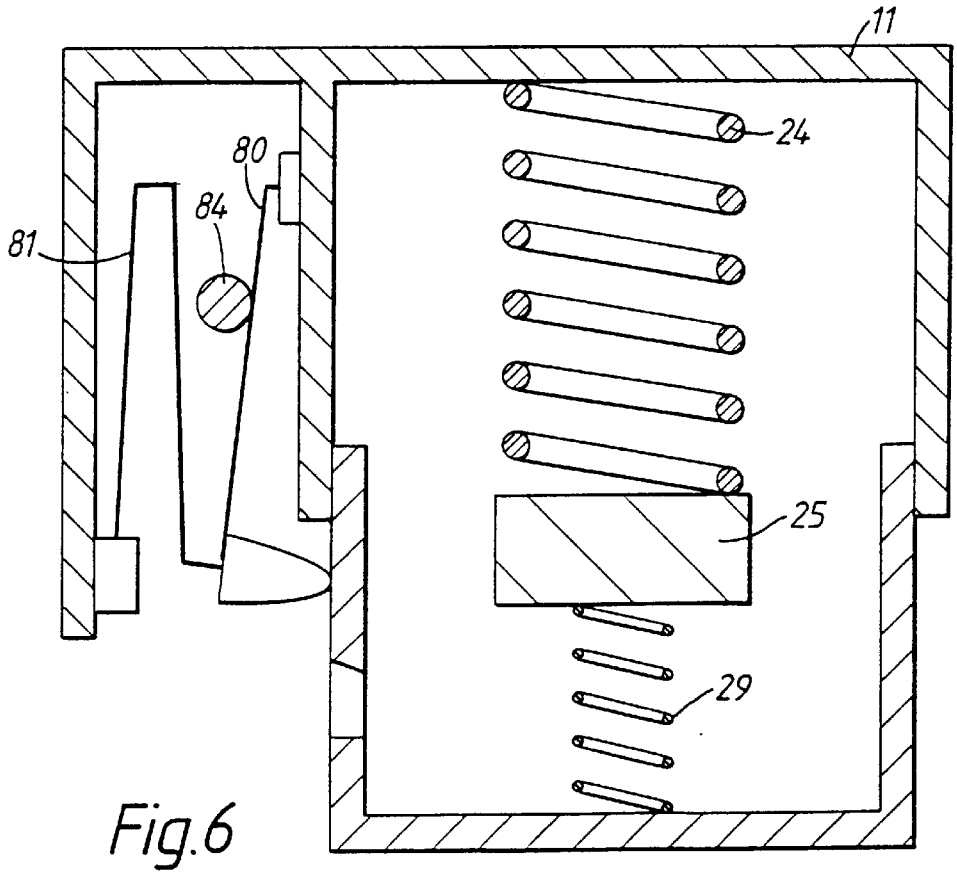
FIG. 6 shows the embodiment of FIG. 5 in a different condition.

The device is illustrated in FIG. 5 in its latched condition, that is with detent pawl 82 engaged with recess 83 in member 12. In this condition, due to the angles of surfaces 82*a* and 83*a* which are in engagement, force F1 which is applied by springs 24 and 29 will apply a force F2 on pawl 82 to the left in the sense of FIG. 5. If the total force F3 applied to pawl 82 towards the right by spring 80 and assembly 81 is greater than force F2 member 12 will be retained in its position illustrated in FIG. 5. However if force F3 reduces to be less than force F2 pawl 82 will be deflected to the left in the sense of FIG. 5 and member 12 will be released to its position shown in FIG. 6.

The device further comprises an adjustable piece 84, shown in cross-section in FIG. 5, which is movable so that it is either in contact with leaf spring 80, as illustrated in FIG. 5, or not in contact with leaf spring 80. This movement can be used to provide two modes of operation for the device as described in detail below. The adjusting piece may be provided in any suitable form, such as a pin, wedge or cam mounted on frame 11. In the first mode of operation adjusting piece 84 is not in contact with leaf spring 80 and plays no part in the operation of the mechanism and therefore can be assumed not present in FIG. 5. The piezo ceramic assembly 81 is arranged such that when it is activated it applies a greater force to the right than when it is not actuated. The leaf spring 80 is designed to have a stiffness such that when the piezo ceramic assembly 81 is not actuated the total force F3 acting to the right on pawl 82 is less than force F2 acting on the pawl to the left. However when the assembly 81 is actuated the total force F3 acting to the right on pawl 32 is greater than force F2 acting to the left. Thus if member 11 is placed in its position shown in FIG. 5 and member 81 is actuated, member 12 will be retained in this position. However is member 81 subsequently becomes de-actuated member 12 will be allowed to move to its release position shown in FIG. 6. Also in the absence of actuation of assembly 81 it will be impossible to re-set the device to leave member 12 held in its position in FIG. 5. If the device of this invention is incorporated in a switch mechanism and member 12 causes the opening of contacts in its FIG. 6 position the device in this mode will be "fail-safe". That is if actuation of the device is not present the device will switch off, if it is on, and will not be able to switched on, if it is off, until such time as the assembly 81 is re-actuated.

In the second mode of operation adjusting piece 84 is positioned in its location illustrated in FIG. 5. The effect of this is that it shortens the effective length of the leaf spring 82 such that its stiffness is increased. This increase is gained because the flexure of a cantilever beam of uniform section is proportional to cube of the length for any given load. With this increased stiffness the force applied towards the right on pawl 82 by leaf spring 80 plus the force applied to the right by assembly 81 in its de-actuated state is larger than F2 and therefore member 12 will be retained in its FIG. 1 position when assembly 81 is not actuated. In this mode when assembly 81 is actuated it applies a force on pawl 82 to the left thereby decreasing total force F3 to be lower than force F2 and releasing member 12. Thus, electrically this is the reverse operation to that of the first mode.

It will be appreciated that in, this embodiment a simple mechanical movement effects a change in the electrical characteristics of the device and there is no necessity to alter any other mechanical parts.

If this device is incorporated in a switch device having associated electrical circuitry, for instance mounted on a printed circuit board, the movement of adjusting piece 84 can be arranged to make electrical changes to the circuitry so that it too operates in two modes. This may be simply by operation of a micro-switch on the circuit board. This facility has particular manufacturing advantages in a situation where two similar devices, having similar switch mechanisms, are being made. A single manufacturing line be used to make the switch mechanism and the actual characteristics of the device selected by the positioning of adjusting piece 84.

Alternatively the device may be arranged such that a user of the device, properly instructed, can change the operation of the device between its two modes.

Attention is now directed to the mechanism for engaging the contacts 32 and 33. In certain embodiments of the invention, the sequence of engagement of the twin pole switch is important. In residual current devices it is often important that the neutral line must be made first and broken last and it is therefore necessary to apply positive bias to the assembly. An embodiment of means for effecting this bias with very few components follows.

Figure 7:
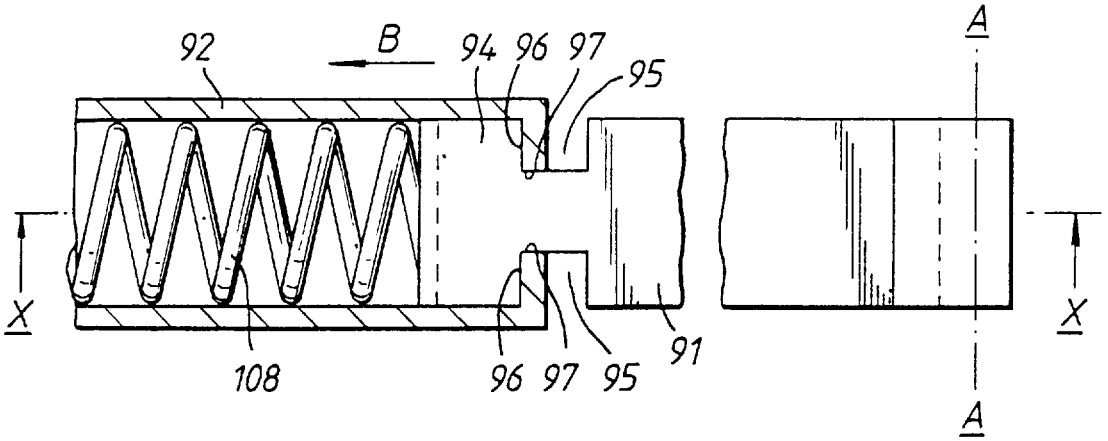
FIG. 7 is a top view of a shorting bar contact device.
Figure 8:
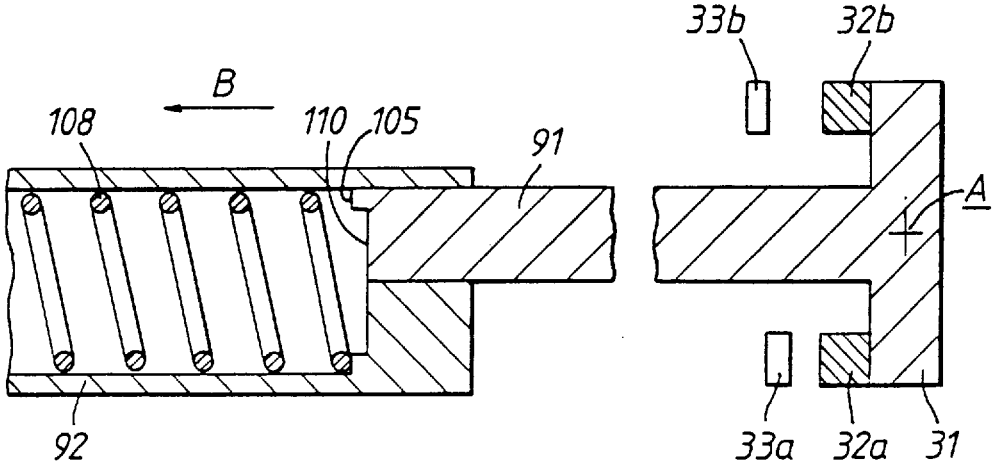
FIG. 8 is a sectional side view of the same shorting bar contact device.
Figure 9:
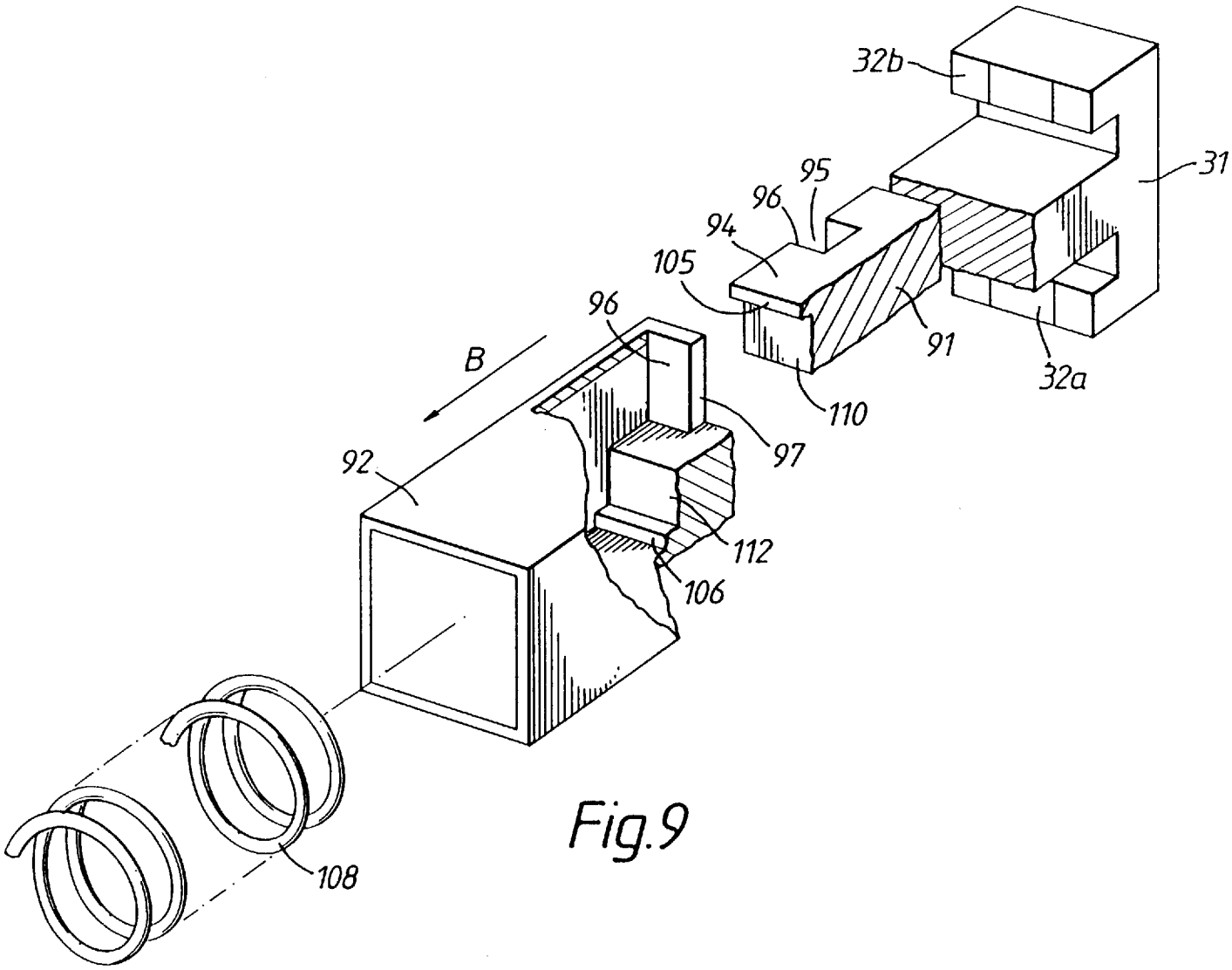
FIG. 9 is an isometric view of the shorting bar contact device.

A shorting bar contact means, shown in FIGS. 7 to 9, comprises two main parts—an actuating bar 90 and a carrier bracket 92, the carrier bracket 92 being slidingly moveable in a direction B parallel to its longitudinal axis. Rigidly connected to one end of the actuating bar 91 is a platform 31 which carries in-line shorting bars 32*a*,32*b*. The bars may be movable with respect to the platform 15.

The other end of the actuating bar 91 is shaped with a recess 95 in each side creating a pair of oppositely facing lips 94 each having a downward facing surface 96, and the carrier bracket 92 has a pair of steps 97 on which the downward facing surfaces 96 of the actuating bar 91 rest when the device is assembled. Where the actuating bar 91 links to the carrier bracket 92 it has a step 105 which resides adjacent a similar step 106 on the carrier bracket 92 such that when 4 assembled, the two steps form substantially coplanar surfaces. The recess 95 in either side of the actuating bar 91 is such that the actuating bar can rotate with respect to the bracket 92 about an axis parallel to the axis A shown, which is parallel to the in-line plane of the in-line shorting bars 32*a*, 32*b*.

A spring 108 is contained by the carrier bracket 92 and is of such a size that its coils span both the step 105 on upper surface 110 of the actuating bar 91 and the step 106 on the upwardly facing surfacing 112 of the carrier bracket 92. The compression of the spring 108 due to its free end being compressed e.g. against an outer casing, biases the actuating bar 91 into an un-rotated position and further biases the carrier bracket 92 and actuating bar 91 to its non-contact making position (to the right as the device is drawn in FIG. 7).

Associated with each shorting pair 32*a*,32*b* is a pair of fixed shorting contacts 33*a*,33*b*. The fixed contacts 33*a*, 33*b* are positioned between the limits of motion in a direction B and the rest position or the assembly such that the shorting bars 32*a*,32*b* meet the fixed contacts 33*a*,33*b* during the actuation cycle. One set of contacts 33*b* are further away from the non-contact making position of the platform 31 than the other set of contacts 33*a* such that contact is first made between the starting bar 32*a* and the contacts 33*a*.

When the engagement mechanism (not shown) is activated, it pulls the bracket 92 in a direction B and the interaction between the step 97 of the bracket and the lip 94 of the activating bar 1 also causes the actuating bar to move in direction B until the first shorting bar 32*a* connects with its fixed contacts 33*a*. The fixed contacts 33*a* then prevent the actuating bar from further movement in direction B. Instead, further pulling of the bracket 92 by the engagement mechanism results in rotation of the actuating rod 91 (anti-clockwise as drawn in FIG. 8) about the axis of contact of the first fixed contacts 33*a* until the second shorting bar 32*b* engages its associated fixed contacts 33*b*.

Upon release of the engagement mechanism, the extra compression of the spring 108 on the step 105 on the upper surface 110 of the actuating rod 91, arising from the-rotation of the actuating rod 91 causes this side to rotate (clockwise as drawn in FIG. 8) away ensuring that contact on this side 33*b* is broken before the longitudinal movement of the assembly under the action of the spring 108 results in contact on the first contacts 33*a* being broken.

I claim:

1. A detent mechanism comprising a support member having a fixed seating member comprising opposite sides:

a first spring for exerting a first spring force, disposed between one side of the fixed seating member and a first slidable seating member, further comprising a second spring member exerting a second spring force less than said first spring force, disposed between the other side of said fixed seating member and a second slidable seating member, whereby the forces of the springs are directed to operate on said first and second slidable members in opposite directions, means for applying an external force to the first slidable seating member to move the first slidable seating member from a first position relative to the fixed seating member to a second position against the action of said first spring force, and means-for releasably connecting the first slidable seating member to said second slidable seating member when said first sliding member is in its second position and said second slidable member is in a first position, such that when said members are not acted on by said external force, said first slidable member returns towards its first position and said second slidable member is constrained to move with said first slidable member to a second position, the resultant force on both said slidable members in the direction of said first spring force being the difference between said first spring force and said second spring force characterised in that the releasably connecting means comprises an electromechanical arrangement carried by one of said suitable seating members, which arrangement includes a detent and an electrically energised device for controlling the movement of said detent.

2. A detent mechanism according to claim 1 wherein a means for applying a force to said detent comprises a leaf spring mechanically attached to said detent.

3. A detent mechanism according to claim 2 wherein the device includes a solenoid.

4. A detent mechanism according to claim 2 wherein the device includes a piezo-electric element.

5. A detent mechanism according to claim 2 wherein, in a first state of the device, said device and leaf spring exert a sufficient force to overcome the net spring force on said first and second slidable members due to the opposite forces of said first and second springs, and wherein in a second state of said device, said device and leaf spring in combination do not exert a sufficient force to overcome the net spring force on said first and second slidable members due to the opposite forces of said first and second springs.

6. A detent mechanism according to claim 1 further comprising a manually operable slidable seating member, a third spring, weaker than either of said first or second springs, disposed between said manually operable slidable seating member and said first slidable seating member.

7. A detent mechanism according to claim 6 wherein, on manual operation of said manually operable member from its rest position over a first range of positions to a second position, no movement of said first and second slidable members is caused, and on further operation over a second range of positions between said second and a third position, reciprocal movement of said first slidable member is caused between said first position and said second position of said first slidable member.

8. A detent mechanism according to claim 7 wherein said means for releasably connecting said first slidable member and said second slidable member acts to connect said first and second slidable members in the presence of an external condition, and acts to release said first and second slidable members in the absence of said external condition.

9. A detent mechanism according to claim 8, wherein said external condition is an electrical condition.

10. A detent mechanism according to claim 8 wherein said range of positions of said manually operable member further comprises a third range of positions wherein one limit of said third range is in said first range of positions, and wherein said third position of said manually operable slidable member is not in said third range of positions, whereby movement of said manually operable slidable member in a direction from its rest position towards its third position through said third range causes the absence of said external condition over said third range, and whereby movement of said manually operable slidable member in a direction from its third position to its rest position at no point causes the absence of said external condition.

11. An electrical switching device according to claim 8 further comprising a set of electrical contacts, wherein, when said second member is in its first position, said contacts are in a first state, and when said second member is in its second position, said contacts are in a second state.

12. An electrical switching device according to claim 11 wherein, said set of contacts comprise live and neutral mains contacts, and wherein the first state of said contacts is open and wherein the second state of said contacts is closed.

13. An electrical switching device according to claim 12 wherein said external condition is the equal flow of current through said live and neutral mains contacts.

14. An electrical switching device according to claim 13 wherein said device is a residual current device.

15. An electrical switching device including a detent mechanism according to claim 1.

* * * * *